US007025090B2

(12) United States Patent
Bramley et al.

(10) Patent No.: US 7,025,090 B2
(45) Date of Patent: Apr. 11, 2006

(54) FLUID FLOW CONTROL VALVES

(75) Inventors: Hugh Christopher Bramley, Alcester (GB); Christopher Simon Patient, Lichfield (GB)

(73) Assignee: IMI Norgren Limited, (GB)

( * ) Notice: Subject to any disclaimer, the term of this patent is extended or adjusted under 35 U.S.C. 154(b) by 0 days.

(21) Appl. No.: 10/415,313

(22) PCT Filed: Oct. 30, 2001

(86) PCT No.: PCT/GB01/04820

§ 371 (c)(1),
(2), (4) Date: Jan. 22, 2004

(87) PCT Pub. No.: WO02/38966

PCT Pub. Date: May 16, 2002

(65) Prior Publication Data

US 2004/0112440 A1 Jun. 17, 2004

(30) Foreign Application Priority Data

Oct. 31, 2000 (GB) ..... 0026650

(51) Int. Cl.
*F15B 13/00* (2006.01)

(52) U.S. Cl. ..... 137/596.16; 137/271; 137/884

(58) Field of Classification Search ..... 137/271, 137/596.16, 884
See application file for complete search history.

(56) References Cited

U.S. PATENT DOCUMENTS 6,397,880 B1 * 6/2002 Stoll et al. ..... 137/271
6,715,400 B1 * 4/2004 Muth et al. ..... 137/884

FOREIGN PATENT DOCUMENTS

DE 29810091 U1 1/1999
EP 0955473 A1 11/1999
GB 2301167 A 11/1996

* cited by examiner

*Primary Examiner*—Stephen M. Hepperle
(74) *Attorney, Agent, or Firm*—Pillsbury Winthrop Shaw Pittman, LLP

(57) ABSTRACT

A fluid flow control valve system has a plurality of pairs of 3 port, 2 position (3/2) control valves (6, 6') each valve being movable between its two positions by a pair of electrically-operable actuators (1, 2). A logic controller selectively generates electrical control signals for independently controlling operation of the pairs of 3/2 control valves, and a circuit means (11) is associated with each 3/2 control valve pair (6, 6') to receive the control signals and provide electrical outputs to eit actuators (1, 2) of each 3/2 control valve of each pair. Variable switch means (14) forming part of the circuit means (11) pr the actuators (1, 2) to which the output is applied. Varying the switch means (14) programmes the fluid output mode of each 3/2 control valve pair to provide any one of a number of different effective valve types.

23 Claims, 4 Drawing Sheets

| Effective Valve Type | Valve Outputs | | Logic Inputs | | | | Outputs | | | | Logic Control Signal | | | | Switch Position |
|---|---|---|---|---|---|---|---|---|---|---|---|---|---|---|---|
| | | | | | | | Port 7 | | Port 8 | | | | | | |
| | Port 7 | Port 8 | A | B | C | D | 1 | 2 | 3 | 4 | 1 | 2 | 3 | 4 | |
| 5/2 Sol/Spring | Pressure | Exhaust | 0 | 0 | 0 | 0 | 1 | 0 | 1 | 0 | A | A | A | A | 2 |
| | Exhaust | Pressure | 1 | 0 | 0 | 0 | 0 | 1 | 0 | 1 | | | | | |
| 5/2 Sol/Sol | Pressure | Exhaust | 0 | 1 | 0 | 0 | 1 | 0 | 1 | 0 | B | A | B | A | 1 |
| | Exhaust | Pressure | 1 | 0 | 0 | 0 | 0 | 1 | 0 | 1 | | | | | |
| 5/3 COP | Pressure | Exhaust | 1 | 0 | 0 | 0 | 1 | 0 | 1 | 0 | B | B | A | A | 4 |
| | Pressure | Pressure | 0 | 0 | 0 | 0 | 1 | 0 | 0 | 1 | | | | | |
| | Exhaust | Pressure | 0 | 1 | 0 | 0 | 0 | 1 | 0 | 1 | | | | | |
| 5/3 COE | Pressure | Exhaust | 0 | 1 | 0 | 0 | 1 | 0 | 1 | 0 | B | $\overline{B}$ | $\overline{A}$ | A | 3 |
| | Exhaust | Exhaust | 0 | 0 | 0 | 0 | 0 | 1 | 1 | 0 | | | | | |
| | Exhaust | Pressure | 1 | 0 | 0 | 0 | 0 | 1 | 0 | 1 | | | | | |
| 2 Off 3/2 Sol/Sol | Pressure | Pressure | 1 | 0 | 0 | 1 | 1 | 0 | 0 | 1 | A | B | C | D | 5 |
| | Pressure | Exhaust | 1 | 0 | 1 | 0 | 1 | 0 | 1 | 0 | | | | | |
| | Exhaust | Pressure | 0 | 1 | 0 | 1 | 0 | 1 | 0 | 1 | | | | | |
| | Exhaust | Exhaust | 0 | 1 | 1 | 0 | 0 | 1 | 1 | 0 | | | | | |
| 2 Off 3/2 Sol/Spring NC | Pressure | Pressure | 1 | 1 | 0 | 0 | 1 | 0 | 0 | 1 | B | B | A | A | 3 |
| | Pressure | Exhaust | 0 | 1 | 0 | 0 | 1 | 0 | 1 | 0 | | | | | |
| | Exhaust | Pressure | 1 | 0 | 0 | 0 | 0 | 1 | 0 | 1 | | | | | |
| | Exhaust | Exhaust | 0 | 0 | 0 | 0 | 0 | 1 | 1 | 0 | | | | | |
| 2 Off 3/2 Sol/Spring NO | Pressure | Pressure | 0 | 0 | 0 | 0 | 1 | 0 | 0 | 1 | B | B | A | A | 4 |
| | Pressure | Exhaust | 1 | 0 | 0 | 0 | 1 | 0 | 1 | 0 | | | | | |
| | Exhaust | Pressure | 0 | 1 | 0 | 0 | 0 | 1 | 0 | 1 | | | | | |
| | Exhaust | Exhaust | 1 | 1 | 0 | 0 | 0 | 1 | 1 | 0 | | | | | |

*Fig. 4*

FLUID FLOW CONTROL VALVES

CROSS REFERENCE TO RELATED APPLICATION

This application claims priority to PCT Application No. PCT/GB01/04820, filed Oct. 30, 2001, incorporated herein by reference, which claims priority to United Kingdom Application No. 0026650.2, filed Oct. 31, 2000.

This invention relates to fluid flow control valves and more particularly to valves for controlling fluid-powered devices such as, for example, actuating cylinders. The invention is applicable to pneumatic and hydraulic control valves but, for convenience, this specification refers largely to the former.

It is now commonplace in, for example, production machinery for all of the actuating cylinders to be controlled by respective directional control valves which are usually mounted on one and the same 'valve island'. Such valve islands have the advantage of compactness and ease of connection of electrical and pneumatic lines. However, to a large extent, a valve island has to be custom-built to suit its particular application and it is not uncommon for a particular valve island to require two or more types of control valve mounted on it in a specific order. There is, therefore, a need to manufacture and assemble different types of control valve in differing combinations both for original equipment and for spares. If the end-user has many different types of valve island, he must either keep a spare for each type, or risk his apparatus being inoperative while a spare is obtained. This is, of course, expensive both for the manufacturer and particularly for the end-user. It is an object of the present invention to solve or at least mitigate that problem.

According to one aspect of the present invention, there is provided a fluid flow control valve system comprising a plurality of pairs of 3 port, 2 position ("3/2") control valves, each 3/2 control valve being movable between its two positions by a pair of electrically-operable actuators, a logic controller for selectively generating electrical control signals for independently controlling operation of the pairs of 3/2 control valves, and associated with each 3/2 control valve pair, respective circuit means for receiving the said electrical control signals and providing electrical outputs based on the control signals to either of the actuators of each 3/2 control valve of each pair as pre-selected by variable switch means forming part of the circuit means, whereby varying the switch means programmes the fluid output mode of each 3/2 control valve pair to provide any one of a plurality of different effective valve types.

By the expression "fluid output modes" there is meant, for each 3/2 valve in a pair, a fluid pressure signal, connection to exhaust, or a blocked output, depending on the electrical output applied to it. For each pair of 3/2 valves (referred to in the table below as valve 1 and valve 2), therefore, there are, at any given time, nine possible combinations of output modes, as follows:

| | Output of Valve 1 | Output of Valve 2 |
|---|---|---|
| 1 | Fluid pressure | Fluid pressure |
| 2 | Fluid pressure | Exhaust |
| 3 | Fluid pressure | Blocked |
| 4 | Exhaust | Fluid pressure |
| 5 | Exhaust | Exhaust |
| 6 | Exhaust | Blocked |
| 7 | Blocked | Fluid pressure |

-continued

| | Output of Valve 1 | Output of Valve 2 |
|---|---|---|
| 8 | Blocked | Exhaust |
| 9 | Blocked | Blocked |

Of these nine combinations, only five, namely Nos 1, 2, 4, 5 and 9 are normally used to control, for example, a double-acting fluid-actuated cylinder. As will be explained later herein, each 3/2 valve pair may, in accordance with the invention, readily be programmed to achieve any one of the most commonly used combinations either in mono-stable form (so-called Solenoid-Spring or, in abbreviated form, "Sol/Spring") or in bi-stable form (so-called Solenoid/Solenoid or, in abbreviated form, "Sol/Sol"). In other words, each 3/2 valve pair may be independently programmed to provide any one of a plurality of effective valve types including a 5/2 Sol/Spring valve, a 5/2 Sol/Sol valve, a 5/3 COP ("centre open to pressure") valve, a 5/3 COE ("centre open to exhaust") valve, two 3/2 Sol/Sol valves, two Sol/Spring NO ("normally open") valves or two Sol/Spring NC ("normally closed") valves.

In a preferred embodiment of the invention, the plurality of pairs of 3/2 control valves are located adjacent to one another to form a valve island and the respective circuit means are located on the valve island. As such, the electrical outputs of a logic controller, such as a conventional programmable logic controller (commonly referred to in the art as a "PLC"), may simply be connected to the inputs of the respective circuit means to provide a system as defined above. As will be appreciated, the control signals may be transmitted over an addressable serial communication system, for example a Fieldbus system, as an alternative to more traditional multi-conductor systems.

Preferably, the valve island includes a base on which the 3/2 control valves are mounted. The base may be one-piece or modular in form and preferably contains all of the fluid and electrical connections necessary for operation of the valve island. This reduces the amount of pipework and electrical wiring necessary in an installation.

The respective circuit means are preferably embodied in a printed circuit board mounted on the valve island. The printed circuit board is preferably detachably mounted on the valve island so that, in the event of a malfunction, it may readily be removed for repair or replacement without disturbing the 3/2 valves and fluid connections. Where the island includes a base, such printed circuit board is preferably mounted on the base.

The switch means forming part of each circuit means may be mechanical or solid state in nature. In the latter case in particular, the switch means may be invariable by the end user having, for example, been pre-programmed by the manufacturer in accordance with the end-user's requirements, or may be remotely programmed and re-programmed, eg. by down-loading software into them.

The valve island itself also constitutes an aspect of the invention. Thus, according to a second aspect of the invention, a valve island for a fluid flow control system has a plurality of pairs of 3 port, 2 position 3/2 control valves, each 3/2 control valve being movable between its two positions by a pair of electrically-operable actuators, and respective circuit means associated with each pair of 3/2 control valves for receiving electrical control signals and providing electrical outputs based on the control signals to either of the actuators of each 3/2 control valve of each pair, as pre-selected by variable switch means forming part of the circuit means, whereby varying the switch means programmes the fluid output mode of each 3/2 control valve pair to provide any one of a plurality of different effective valve types.

The further features of the valve island mentioned above also apply to the second aspect of the invention.

As noted above, a feature of either aspect of the invention is that any one or more of the 3/2 valve pairs can be arranged to act in mono- or bi-stable fashion. However, since each of the 3/2 valves is basically bi-stable, it is necessary to ensure that, in the case where a mono-stable function is required, sufficient electrical power will be available for powering the relevant actuators eg. solenoids, in the event of a power failure. To that end, each circuit means may include, for example, a capacitative circuit from which current can be discharged to this or that actuator in the event of a power failure whereby mono-stable operation can be satisfied. Indeed, this technique has general application to electrically operated bi-stable fluid flow control valves adapted to function in a mono-stable manner.

Thus, according to a third aspect of the present invention, there is provided a fluid flow control valve movable between its positions by electrically-operable-actuators wherein a control means for the actuators includes a capacitative means from which current is discharged to an appropriate actuator in the event of power failure.

This provides the equivalent of a spring return function, ensuring that the valve is fail-safe in the event of power failure. This is particularly applicable to 3/2 or 5/2 control valves operated by solenoids or solenoid-operated pilot valves.

In all aspects of the invention, the control valves may be spool valves, and the actuators are preferably solenoids or solenoid-operated pilot valves.

In its first and second aspects, the invention enables a "universal" valve island to be selectively programmed to provide a multiplicity of different valve functions. This has the important advantage that the valve island manufacturer can make available to its customers the valve functions required for operation of, say, a particular machine by supplying a standard valve island and appropriate control circuitry. This should be contrasted to the conventional practice of custom-building islands comprising differing valve combinations in differing orders depending on the application in question.

An embodiment illustrating all aspects of the present invention will now be described in more detail, by way of example only, with reference to the accompanying drawings in which:

FIG. 4 is a logic table showing how various effective valve types/outputs may be achieved from each 3/2 valve pair.

Figure 1:
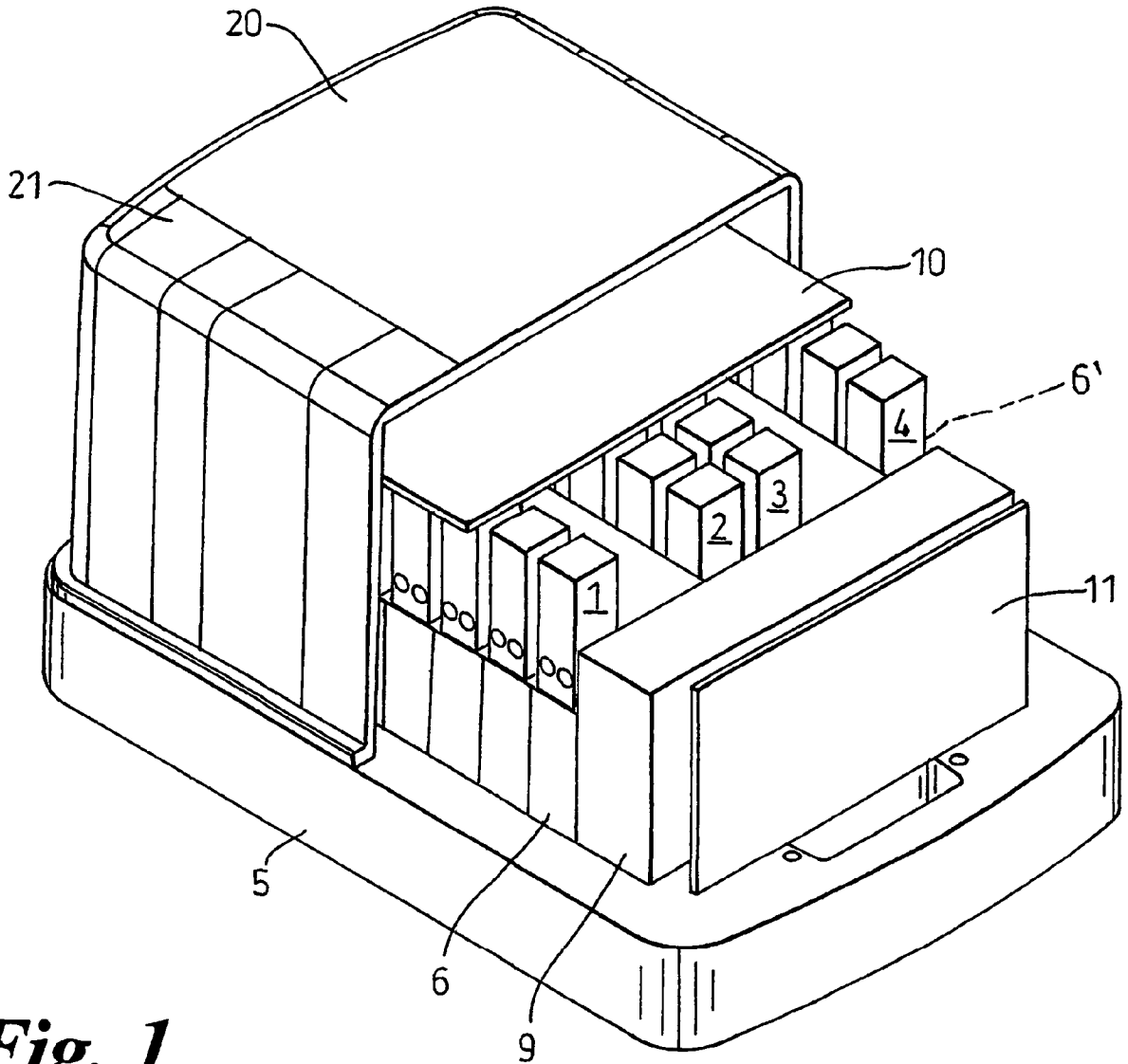
FIG. 1 is a schematic, partly cut-away perspective view of a valve island for a fluid flow control valve system constructed in accordance with the invention.
Figure 2:
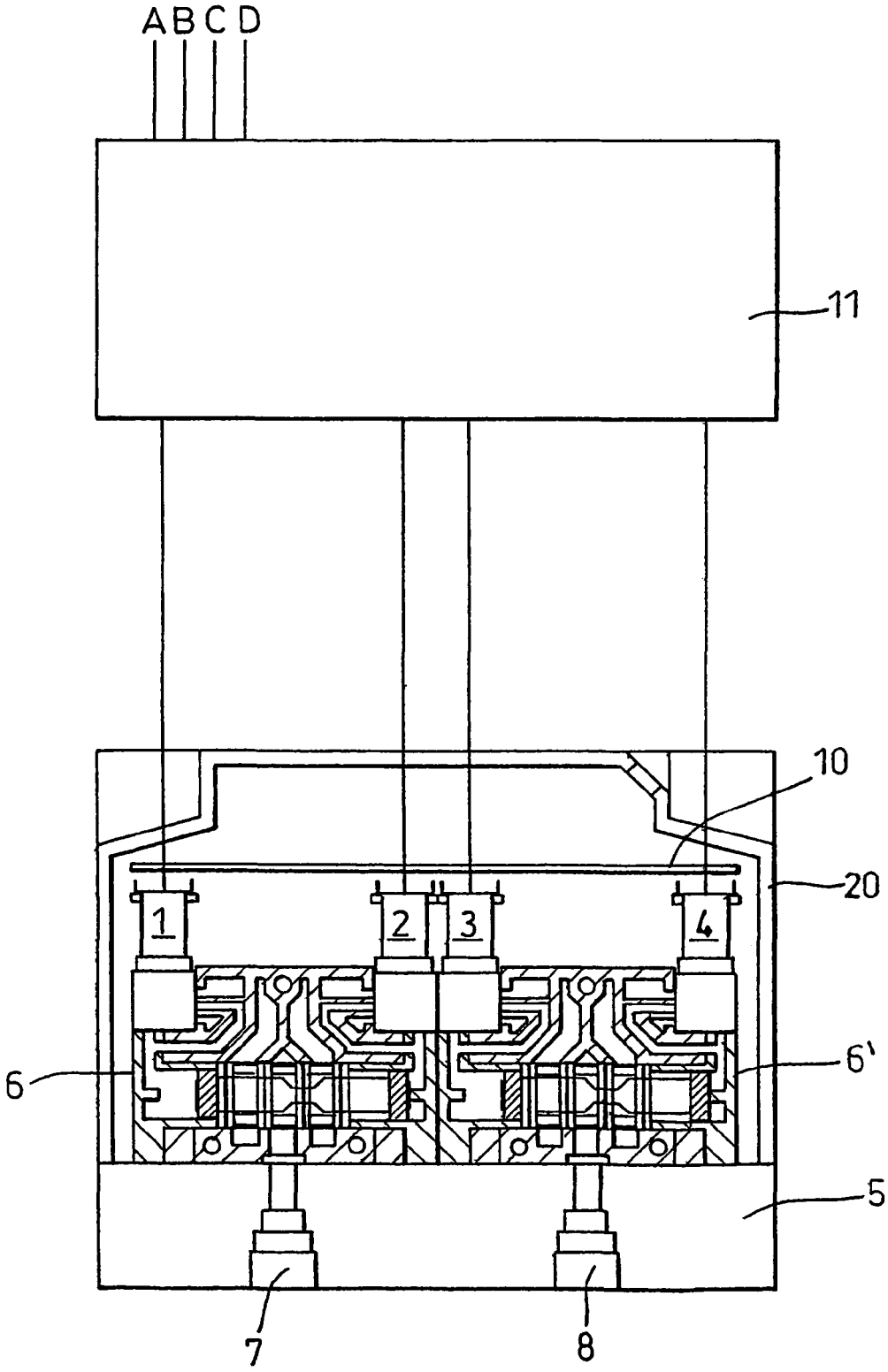
FIG. 2 is a cross-section of the valve island substantially as shown in FIG. 1 showing one pair of 3/2 valves and, schematically, their electrical connections, via their respective circuit means, to a programmable logic controller for producing electrical control signals.

Referring first to FIGS. 1 and 2, the valve island comprises a base 5 having mounted on it eight pairs of 3/2 pneumatic spool valves. One pair of valves is designated 6, 6'. The general mode of construction and operation of such valves will be very familiar to those skilled in the art and so need not be described herein. There could, of course, be any number of valve pairs on the island, depending on the fluid flow control system in which the island is to be used. The base 5 is shown to be of one-piece form, but it could comprise a number of modules secured together. The valves of each pair are arranged in end-to-end relationship, as shown by 6 and 6', and are each formed as a separate body. However, each pair of valves could be accommodated in a unitary body, as indeed could all of the valves on the island.

Referring specifically to FIG. 2, which shows the pair of 3/2 valves 6, 6' in section, the output port of the valve 6 communicates, via a passageway formed in the base 5, with an output port 7, whereas the output port of the valve 6' communicates, via a passageway formed in the base 5, with an output port 8. The other valve pairs are similarly associated with respective pairs of output ports formed in the base 5. In use, each pair of output ports 7, 8 etc is connected via respective pipelines to, for example, a double-acting pneumatic cylinder, whose operation is to be controlled by its associated 3/2 valve pair.

The pairs of 3/2 valves 6, 6' etc are secured together, and to the base 5, by suitable fasteners (not shown), so as to form a unitary assembly. As in many conventional valve islands, a compressed air source is connected to each of the 3/2 valves by a series of intercommunicating passageways which terminate in a compressed air inlet port (not shown) formed in a block 9 secured to the end of the assembly. The block 9 also defines a pair of compressed air exhaust ports which communicate respectively with interconnected exhaust ports of all of the 3/2 valves 6 etc in one row and with interconnected exhaust ports of all of the 3/2 valves 6' etc in the other row.

Each 3/2 valve is operated between its two positions by two solenoid-operated pilot air valves, that is to say that each of the 3/2 valves is capable of bi-stable operation. Accordingly, each pair of 3/2 valves 6, 6' etc has four solenoid coils. In FIGS. 1 and 2, the solenoid coils associated with the valve 6 are designated 1 and 2, whereas those associated with the valve 6' are designated 3 and 4.

Electrical power is fed to the coils 1, 2, 3 and 4 etc, as appropriate and as described in more detail below, by individual "live" conductors formed in a printed circuit board 10 mounted on top of the coils. The printed circuit board 10 also has interconnected "ground" conductors common to all of the coils 1, 2, 3 and 4 etc.

The individual live conductors and the ground conductors are connected, for example by plug-in connectors (not shown), to a printed circuit board 11 mounted on the base 5. As described below, the printed circuit board 11 embodies the circuit means referred to above of the valve island. In use, each of 3/2 valves 6, 6' is operated by control signals generated by a programmable logic controller (PLC), not shown, or the like which are fed to the printed circuit board 11. In FIG. 2, those control signals are designated A, B, C and D.

The 3/2 valve assembly and the printed circuit boards 10 and 11 are enclosed in a removable housing 20 secured to the base 5.

Figure 3:
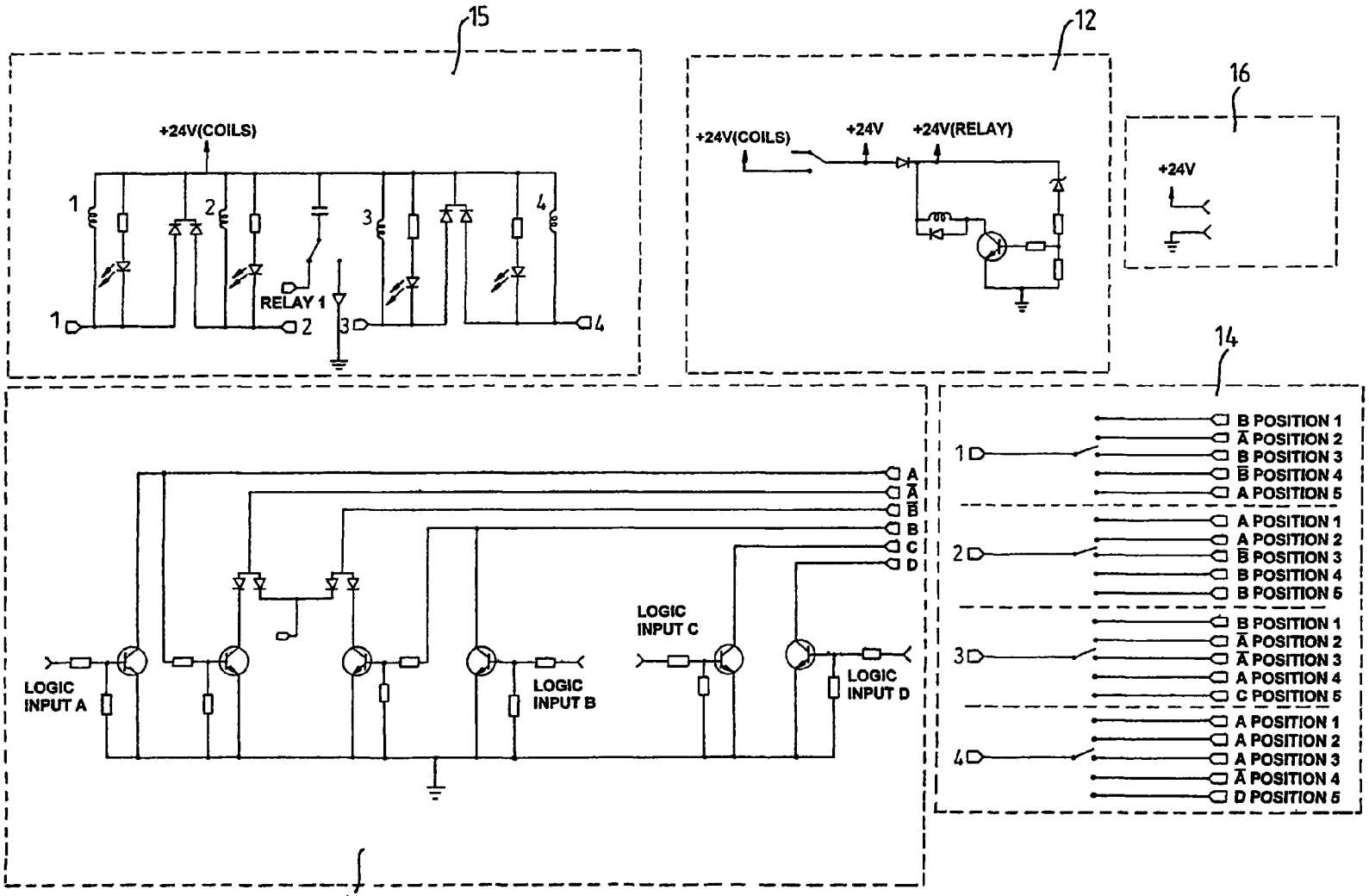
FIG. 3 is a circuit diagram of one form of circuit means.

Referring now to FIG. 3, this illustrates in detail, using conventional symbols, the circuit embodied in the printed circuit board 11 for producing pre-determined effective valve types for each pair of 3/2 valves 6, 6' etc. There is such a circuit for each valve pair and so, in the embodiment illustrated, there will be eight such circuits on the board 11.

Each circuit is driven by a common power supply circuit 12, also mounted on the board 11, and comprises a logic inversion circuit 13, a mechanical valve-mode selection switch 14 and a solenoid coil control circuit 15. It will be apparent from FIG. 3 how these sections are connected together, but briefly it is as follows.

The "+24v (COILS)" output terminal of the power supply circuit 12 is connected to the "+24v (COILS)" common power rail of the solenoid coil control circuit 15. The "+24 v (RELAY)" input terminal of the power supply circuit 12 is, in use of the valve island, connected to the "+24v" output terminal of an external 24v DC power supply 16.

With specific reference to the coil control circuit 15, each solenoid coil 1, 2, 3 and 4 is connected, via respective connections also numbered 1, 2, 3 and 4 to respective terminals 1, 2, 3 and 4 of the valve-mode selection switch 14. The latter comprises a multi-position slide switch which is switchable into any one of five positions so as to determine which input control signal A, B, C, D or the inverse of A (designated $\overline{A}$) or of B (designated $\overline{B}$) is used to energise which of the coils 1, 2, 3 and 4. To that end, the output terminals A, $\overline{A}$, B, $\overline{B}$, C and D shown in the logic inversion circuit 13 are connected to the corresponding input terminals A, $\overline{A}$, B, $\overline{B}$, C and D of the valve-mode selection switch 14. Although it will be self-evident to those skilled in the art, the aforementioned inverse signals $\overline{A}$ and $\overline{B}$ are automatically generated by the logic inversion circuit 13 when there is no signal A or B, respectively, present and these inverse signals provide the "spring" function where a mono-stable valve function is required.

Finally, in use, the PLC outputs A, B, C and D are input to the logic inversion circuit 13 where they are shown as "Logic Input A" etc.

As noted above, the valve-mode selection switch 14 may be selectively switched into any one of five positions such that the effective valve type of each valve pair, eg. 6, 6' with which the particular switch 14 is associated may be pre-programmed. The valve types achievable for each of those five positions is shown in FIG. 4. This latter also indicates, for each effective valve type, the relationship between the inputs A, B, C and D and the state of the output ports 7 and 8, of each valve pair 6, 6' etc. This will now be described in more detail with reference to the switch 14 being in Position 3, which gives a 2 off 3/2 Sol/Spring, normally-closed (NC) valve function, although the valve pair may also act, in that switch position, as a 5/3 COE (centre open to exhaust) valve.

More particularly, and referring to the valve-mode selection switch 14, it will be seen that when the switch is in Position 3, a control signal B from the PLC will be fed to the solenoid coil 1, an inverse $\overline{B}$ of a control signal B generated by the circuit 13 will be fed to the solenoid coil 2, an inverse control signal $\overline{A}$ of a control signal A generated by the circuit 13 will be fed to the solenoid coil 3 and a control signal A will be fed to the solenoid coil 4. Referring now to FIG. 4, four different combinations of output port 7 and 8 states may be achieved with various PLC input signals as shown in the following table, where the presence of an input signal is represented by "1" and the absence of an input signal by "0".

| | | PLC Input | | | |
|---|---|---|---|---|---|
| Port 7 | Port 8 | A | B | C | D |
| Pressure | Pressure | 1 | 1 | 0 | 0 |
| Pressure | Exhaust | 0 | 1 | 0 | 0 |
| Exhaust | Pressure | 1 | 0 | 0 | 0 |
| Exhaust | Exhaust | 0 | 0 | 0 | 0 |

Thus, in order to obtain a Pressure/Pressure state, it is necessary to energise pressure solenoid coils 1 and 4 and so PLC input signals B and A respectively need to be generated by the PLC. In order to obtain a Pressure/Exhaust state, an input signal B is again used to energise the pressure coil 1 and the inverse of input A obtained from the logic inversion circuit 13 is used to energise the exhaust coil 3. In order to obtain an Exhaust/Pressure state, input A is used to energise the pressure coil 4, whereas the inverse of input B obtained from the logic inversion circuit 13 is used to energise the exhaust solenoid coil 2. For the Exhaust/Exhaust state, no PLC signals are present at A and B and therefore the inverse of those inputs $\overline{A}$ and $\overline{B}$ are generated by the circuit 13 and fed to exhaust coils 3 and 2 respectively.

It will be appreciated that the respective mode selection switches 14 associated with the identical 3/2 valve pairs of a particular valve island may be individually pre-set in any of their five positions whereby valves of various different effective types, as required and identified in FIG. 4, may be realised.

The housing 20 may also accommodate an LCD display 21 for each of the valve pairs 6, 6'. The LCD display is arranged to indicate, for each valve pair, the effective valve type that it is operating as. The display 21 may show the generally recognised symbol forte valve type, or any other easily-understood indication. The LCD could also be used to covey any other appropriate information misting to the valve.

Reverting to the solenoid coil control circuit 15, it can be seen that it includes a capacitor C1 which is continuously charged up by the power supply circuit 12. Thus, in the event that the external supply is interrupted, the relay 1 (see circuit 15) is de-energised whereby the capacitor is connected to the appropriate solenoid coils to provide the spring return (mono-stable) function where applicable.

Further, and as can also be seen, the solenoid coil control circuit includes, for each coil 1 to 4, an LED which provides visible coil-energised or de-energised status information to the user.

The invention claimed is:

1. A fluid flow control valve system having a plurality of control valves, comprising pairs of 3 port, 2 position (3/2) control valves, each said 3/2 control valve being movable between its two positions by a pair of electrically-operable actuators, a logic controller for selectively generating electrical control signals for independently controlling operation of said pairs of 3/2 control valves and, associated with each said 3/2 control valve pair, respective circuit means for receiving said electrical control signals and providing electrical outputs based on said control signals to either of said actuators of each said 3/2 control valve of each pair as pre-selected by variable switch means forming part of said circuit means, whereby varying said switch means programs the fluid output mode of each said 3/2 control valve pair to provide any one of a plurality of different effective valve types.

2. A fluid flow control valve system according to claim 1, in which each said 3/2 valve pair is programmable to provide a mono-stable or bi-stable valve type.

3. A fluid flow control valve system according to claim 1, in which said plurality of pairs of 3/2 control valves are located adjacent to one another to form a valve island, and said respective circuit means are located on said valve island.

4. A fluid flow control valve system according to claim 1, in which said logic controller is a programmable logic controller, whose outputs are connected to inputs of said circuit means.

5. A fluid flow control valve system according to claim 1, in which said control signals from said logic controller are transmitted over an addressable serial communication system.

6. A fluid flow control valve system according to claim 3, in which said valve island includes a base on which said 3/2 control valves are mounted.

7. A fluid flow control valve system according to claim 6, in which said base contains all the fluid and electrical connections necessary for operation of the valve island.

8. A fluid flow control valve system according to claim 3, in which said circuit means are embodied in a printed circuit board mounted on the valve island.

9. A fluid flow control valve system according to claim 8, in which said printed circuit board is detachably mounted on said valve island.

10. A fluid flow control valve system according to claim 6, in which said printed circuit board is mounted on said base of said valve island.

11. A fluid flow control valve system according to claim 1, in which said switch means for each circuit means is solid state.

12. A fluid flow control valve system according to claim 11, in which said switch means is programmable.

13. A fluid flow control valve system according to claim 1, in which each said circuit means includes a capacitative circuit from which current is discharged to an actuator in the event of power failure.

14. A valve island for a fluid flow control system having a plurality of flow control valves, comprising pairs of 3 port, 2 position (3/2) control valves, each said 3/2 control valve being movable between its two positions by a pair of electrically-operable actuators, and respective circuit means associated with each pair of said 3/2 control valves for receiving electrical control signals and providing electrical outputs based on said control signals to either of said actuators of each said 3/2 control valve of each pair, as pre-selected by variable switch means forming part of said circuit means, whereby varying said switch means programs the fluid output mode of each 3/2 control valve pair to provide any one of a plurality of different effective valve types.

15. A valve island according to claim 14, in which said 3/2 control valves are mounted on a base of said valve island.

16. A valve island according to claim 15, in which said base contains all the fluid and electrical connections necessary for operation of said valve island.

17. A valve island according to claim 14, in which said circuit means are embodied in a printed circuit board mounted on said valve island.

18. A valve island according to claim 17, in which said printed circuit board is detachably mounted on said valve island.

19. A valve island according to claim 17, in which said printed circuit board is mounted on said base of said valve island.

20. A valve island according to claim 14, in which said switch means for each said circuit means is solid state.

21. A valve island according to claim 20, in which said switch means is programmable.

22. A valve island according to claim 14, in which each said circuit means includes a capacitative circuit from which current is discharged to an actuator in the event of a power failure.

23. A fluid flow control valve system according to claim 1, wherein the system comprises a capacitative means from which a current may be discharged to said actuator in the event of a power failure.

* * * * *